US009518727B1

(12) United States Patent
Markle et al.

(10) Patent No.: US 9,518,727 B1
(45) Date of Patent: Dec. 13, 2016

(54) SYSTEMS AND METHODS FOR REMOTE STUN

(71) Applicant: TASER International, Inc., Scottsdale, AZ (US)

(72) Inventors: Ryan C. Markle, Peoria, AZ (US); Daniel J. Wagner, Scottsdale, AZ (US)

(73) Assignee: TASER International, Inc., Scottsdale, AZ (US)

( * ) Notice: Subject to any disclaimer, the term of this patent is extended or adjusted under 35 U.S.C. 154(b) by 85 days.

(21) Appl. No.: 14/531,844

(22) Filed: Nov. 3, 2014

(51) Int. Cl.
*F21V 33/00* (2006.01)
*F41H 13/00* (2006.01)
*F21V 17/00* (2006.01)

(52) U.S. Cl.
CPC ..... *F21V 33/0076* (2013.01); *F21V 17/005* (2013.01); *F41H 13/0031* (2013.01)

(58) Field of Classification Search
CPC .. F21V 33/076; F21V 17/005; F41H 13/0025; F41H 13/0018
See application file for complete search history.

(56) References Cited

U.S. PATENT DOCUMENTS 4,486,807 A 12/1984 Yanez
6,256,916 B1 7/2001 McNulty
6,791,816 B2 9/2004 Stethem
7,012,797 B1 3/2006 Delida
7,152,990 B2 12/2006 Kukuk
7,350,466 B2 4/2008 Hendrix
7,524,076 B2 4/2009 Kukuk
7,905,180 B2 3/2011 Chen
8,231,474 B2 * 7/2012 Stethem ..... F41B 15/04 463/47.3
9,267,768 B1 * 2/2016 Chang ..... F41H 13/0025
2005/0073798 A1 * 4/2005 Stethem ..... F21V 33/0076 361/232
2011/0102964 A1 * 5/2011 Bass ..... F41H 13/0025 361/232
2012/0036990 A1 2/2012 Braun
2012/0320567 A1 12/2012 Alosaimi

* cited by examiner

*Primary Examiner* — Peggy Neils
(74) *Attorney, Agent, or Firm* — Lawrence Letham

(57) ABSTRACT

A demotivator encourages a human or animal target to cease moving. Demotivation is accomplished by conducting electricity through target tissue to cause pain or to cause skeletal muscle contractions. An accessory used with a security flashlight provides a remote stun function, demotivation at a distance from the operator of the flashlight by launching wire-tethered electrodes for contact with target tissue. For a demotivator that provides illumination projecting from the front of the demotivator, the accessory mounts over the front and includes a passage through which the illumination passes. The accessory may include a laser sight for aiming the electrodes. The accessory may include a socket for installing a field-replaceable cartridge.

17 Claims, 6 Drawing Sheets

SYSTEMS AND METHODS FOR REMOTE STUN

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
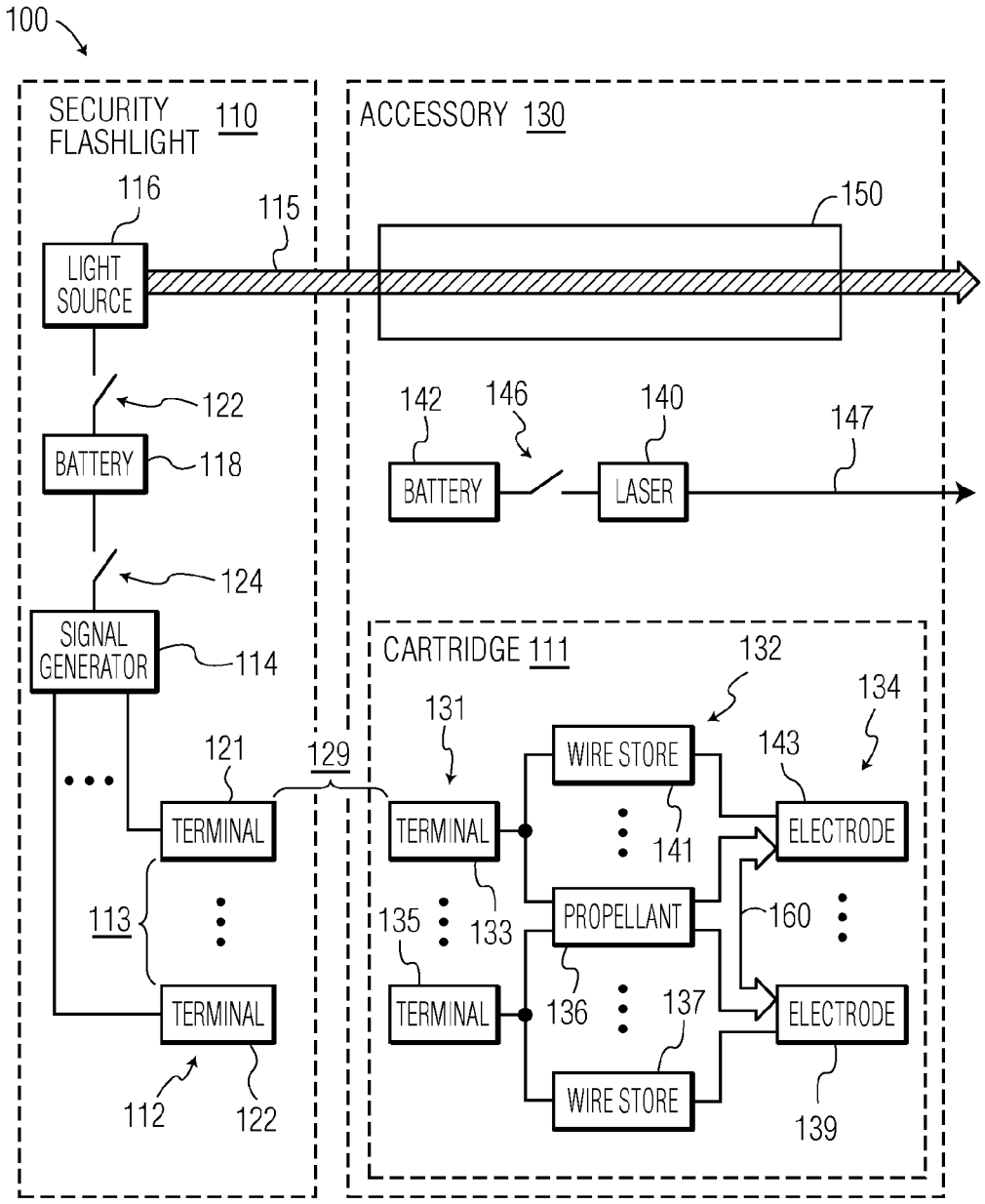
FIG. 1 is a functional block diagram of a self-defense apparatus for providing a remote stun according to various aspects of the present invention.

A demotivator demotivates movement of a human or animal target. Demotivation is accomplished by conducting a current (e.g., stimulus, signal, stimulus signal) through target tissue. For successful demotivation, the current interferes with (e.g., inhibits, impedes) locomotion by the target by causing pain that results in a psychological unwillingness of the target to move and/or by causing skeletal muscle contractions that result in a psychological or physical inability of the target to move thereby halting voluntary locomotion of the target.

The current is generated by a signal generator of the demotivator. The current includes a series of pulses. Each pulse may require an ionizing voltage to ionize air in gaps between target tissue and terminals or electrodes (e.g., lodged in clothing). When three or more electrodes are launched or deployed, the likelihood that two electrodes are positioned in or suitably near (e.g., sum of air gap lengths less than about 2 inches) target tissue is increased.

For electronic demotivators used in law enforcement applications, halting locomotion by the contraction of skeletal muscles is preferred over merely causing pain because a motivated target (e.g., one that does not feel pain or ignores pain) may continue to move and thereby resist arrest unless his or her voluntary locomotion is halted.

When two electrodes couple a stimulus signal generator of the demotivator to a target, pulsing current through the target tissue may cause pain, local skeletal muscle contractions, and/or general skeletal muscle contractions depending on various factors including current pulse width and length of an electrical path through target tissue. Each pulse of the series may have a uniform pulse width of from 50 to 200 microseconds, preferably about 100 microseconds. The pulses of the series may have a repetition rate of from 2 to 40 pulses per second, preferably a repetition rate of greater than 12 pulses per second. When pulse width is relatively short (e.g., 5 microseconds, 10 microseconds, less than 100 microseconds) and/or electrical path length through target tissue is relatively short (e.g., less than one inch, less than 3 inches, about 5 inches) the stimulus signal merely causes pain. When the pulse width is longer (e.g., from 50 to 200 microseconds) and electrical path length through target tissue is longer (e.g., more than about 7 inches) general skeletal muscle contractions are likely to occur thereby halting voluntary locomotion by the target.

A human or animal target may be modeled as one or more circuits between points of coupling between electrodes and target tissue. A circuit through target tissue for passing the current of a stimulus signal may be modeled as an impedance (e.g., resistance). In operation, electrodes from a demotivator become electrically coupled to tissue of a target either directly (e.g., impale target tissue) or indirectly (e.g., impale clothing within arc-forming distance of target tissue).

U.S. Pat. No. 7,042,696 to Smith entitled "Systems and Methods Using an Electrified Projectile"; U.S. Pat. No. 7,057,872 to Smith entitled "Systems and Methods for Immobilization Using Selected Electrodes"; U.S. Pat. No. 5,955,695 to McNulty entitled "Automatic Aiming Non-Lethal Area Denial Device"; U.S. Pat. No. 7,856,929 to Gavin entitled "Systems and Methods for Deploying an Electrode Using Torsion"; and U.S. patent application Ser. No. 12/172,066 to Chiles entitled "Systems and Methods for Demotivating Using a Drape" are incorporated by reference each in its entirety for all purposes, regardless of the context of any further reference below, including teachings of electronic demotivator technologies (e.g., hand-held weapons, grenades, mines, area denial devices, drapes, electrified projectiles).

Demotivator technology has been combined with flashlights to form a device referred to herein as a security flashlight, a type of demotivator. A security flashlight provides a beam of light like a conventional flashlight. A security flashlight includes terminals for providing a stimulus signal. The terminals are spaced apart so that the stimulus signal ionizes air in the gaps between the terminals to produce an arc of visible light. The arc may also provide a distinctive sound. The light and/or sound may act as a warning to a threatening target (e.g., human, animal). The warning may be sufficient for self defense by dissuading the target.

The terminals of a security flashlight may also be held proximate to tissue of a target (e.g., abut, within arc-forming distance, through clothing) to provide a current through target tissue to demotivate the target. The terminals of a security flashlight may be pressed against target tissue. The terminals are proximate when brought close enough to the target so that the current from the security flashlight ionizes the gap (e.g., one to two inches) of air between the terminals and the target to provide the current through the target.

Providing a current through target tissue while terminals of the security flashlight are proximate to tissue of the target is referred to herein as a local stun.

In contrast, some demotivators (e.g., the model X26P marketed by TASER International, Inc.) launch wire-tethered electrodes (e.g., darts) that fly (e.g., deploy) from the demotivator to the target (e.g., 15 to 30 feet away), attach themselves to a target, and provide a current through target tissue via the wire-tethered electrodes. Providing a current through a target via launched wire-tethered electrodes is referred to herein as a remote stun.

Because conventional security flashlights do not include a propulsion system for launching and launched electrodes, conventional security flashlights cannot deliver a remote stun. Because a user of a security flashlight must be physically close to the target to deliver a local stun, the user may be in some jeopardy from a strong or aggressive target. Further, because of the close spacing (e.g., less than 5 inches) of the terminals of a security flashlight, the current provided through target tissue is less likely to result in general skeletal muscle contractions as discussed above. The close spacing of the terminals of a security flashlight likely may only cause pain in a target and thereby prove less effective against a motivated target as discussed above.

According to various aspects of the present invention, a self-defense apparatus includes a security flashlight and an accessory. Such a self defense apparatus administers a remote stun to a target while the target is not proximate to the terminals of the security flashlight. The effectiveness of security flashlights, and the security of users of security flashlights may be improved by installing an accessory onto a security flashlight. The accessory launches wire-tethered electrodes to provide a remote stun. The accessory is preferably installed and removed by the user of the security flashlight, as desired. The self-defense apparatus may perform the functions of a security flashlight, perform a local stun function while terminals of the security flashlight are proximate to a target, and perform a remote stun function by launching wire-tethered electrodes when the target is further away from the self-defense apparatus. A self-defense apparatus may perform additional functions such as providing light for illumination and/or aiming.

An accessory, as used herein, includes any structure that adds remote stun capability to a security flashlight. The addition is preferably accomplished in a field-replaceable manner by a user, without tools. The accessory may be temporarily installed and later removed and/or reinstalled as desired by the user. An accessory may include a cartridge. A cartridge includes any structure that supports a propellant and wire-tethered electrodes to accomplish a remote stun function. The cartridge may be integral to the accessory. The accessory may include a socket for a cartridge that is field-replaceable by a user without tools.

For example, self-defense apparatus 100 of FIGS. 1-8 is operated by a user to illuminate an area in front of the apparatus, to dissuade an attacker, and/or demotivate an attacker. Self-defense apparatus 100 provides light to illuminate an area and/or a laser beam for aiming, performs a local stun function to inhibit locomotion of a target by providing a stimulus signal through the target via terminals, and/or performs a remote stun function to inhibit locomotion of the target by launching electrodes toward a target to deliver a stimulus signal through the target. In one implementation, the electrodes are wire-tethered as discussed above.

Self-defense apparatus 100 includes security flashlight 110 and accessory 130. Security flashlight 110 includes light source 116 that provides beam of light 115, battery 118, switch 122, switch 124, signal generator 114, plurality of terminals 112, and terminals 121 and 122 of the plurality 112 that are separated by distance 113. Accessory 130 includes passage 150, battery 142, switch 146, laser 140 that provides laser beam 147, and a cartridge 111. Cartridge 111 may be integral, allowing accessory 130 suitable for a single deployment; or may be field-replaceable, allowing accessory 130 to be reused with numerous cartridges 111. Cartridge 111, whether integral or separable, includes plurality of terminals 131, plurality of wire stores 132, propellant 136, and plurality of electrodes 134.

While accessory 130 is not coupled to security flashlight 110, security flashlight 110 may operate to deliver a local stun function to a target by bringing terminals 112 proximate to target tissue and providing a stimulus signal (e.g., current) through target tissue via terminals 112. Security flashlight 110 may further display an arc between two or more terminals 112 to provide a visual and audible warning. Security flashlight 110 may couple to accessory 130 to provide a remote stun to a target by launching two or more wire-tethered electrodes 134 to provide a stimulus signal through target tissue via launched electrodes 134. Security flashlight 110 may further provide illumination of an area (e.g., surroundings) and/or a target while coupled to or decoupled from accessory 130. Accessory 130 may provide laser beam 147 from laser 140 to aid in aiming (e.g., pointing, orienting) the direction of deployment of electrodes 134.

Accessory 130 mechanically and electrically couples to security flashlight 110 to accomplish a stable platform for accurately aiming and launching electrodes. Accessory 130 and security flashlight 110 cooperate to launch (e.g., fire, deploy, propel) a suitable quantity of electrodes of plurality of electrodes 134 to provide a stimulus signal through a remote target as discussed above. One launch event may deploy some or all of electrodes 134. In one implementation, accessory 130 provides one concurrent deployment of two electrodes 143 and 139. In another implementation, accessory 130 launches a predetermined quantity of electrodes (e.g., one, two, three, four) of plurality 134 for each of several launches. Each launch may be initiated by the operator at a desired time. A series of launches may be directed to the same target, different targets at the same incident, or different targets of different incidents.

When no propellant remains in accessory 130, the accessory is considered used or expended. An expended accessory 130 may be decoupled from security flashlight 110 and an unexpended (e.g., unused, loaded) accessory 130 coupled to security flashlight 110 for performing additional remote stun functions. According to various aspects of the present invention, coupling accessory 130 to security flashlight 110 does not interfere with the illumination function of security flashlight 110.

A battery includes any structure that stores energy. A battery provides energy to perform a function. A function may include a function of self-defense apparatus 100, security flashlight 110, and/or accessory 130. A function of a security flashlight may include emitting a light to illuminate an area, providing a signal to inhibit locomotion of a target (e.g., stun a target), and providing a warning. A function of an accessory may include providing a beam of light for orienting (e.g., aiming) a direction of deployment of electrodes from the accessory, cooperating with security flashlight 110 to launch electrodes toward a target, and cooperating with security flashlight 110 to provide a stimulus signal through a remote target. A battery may be integrated into security flashlight 110, integrated into accessory 130, or packaged in an external module such as suitable to be worn on the user's belt. A battery may be separable from security flashlight 110 and/or accessory 130. A battery, in whole or in part, may be replaceable. For example, battery 118 powers light source 116. Battery 142 powers laser 140. Any conventional battery technology may be used (e.g., lithium, carbon-zinc, NiMH, NiCad).

A light source includes any structure that provides illumination. Illumination may be visible or for operation of other equipment (e.g., night vision goggles, video camera). Light provided by a source of light may illuminate an area.

A light source may be used for illuminating an area in front of a self-defense apparatus. Illumination from a light source may facilitate a human operator identifying an area, identifying a target, locating objects in an area, identifying potential threats in an area, and indicating the location of a self-defense apparatus. Illumination from a light source may facilitate preparing a visual record (e.g., video recording) of an area and/or an incident (e.g., occurrence, situation, condition, event) that occurs in the area. A light source may include any conventional device that provides light (e.g., incandescent bulb, light emitting diodes (LEDs)). For example light source 116 and laser 140 comprise LEDs. Light source 116 provides light 115 to illuminate an area in front of security flashlight 110. Laser 140 provides laser beam 147 that indicates the direction of deployment (e.g., propagation, flight, travel) and/or a location of impact (e.g., illuminated spot on the target) of one or more electrodes.

A user interface enables a human operator to control the operation of a self-defense apparatus. Controlling an operation of a self-defense apparatus includes starting, stopping, pausing, continuing, verifying, controlling, and/or initiating a function of a self-defense apparatus. Conventional user interface technologies may be used (e.g., mechanical switches, capacitive switches). For example, switches 122, 124, and 146 may be implemented with mechanical slide switches, toggle switches, momentary push-on, and/or toggle push-on push-off switches). Switch 122 enables and disables light source 116. Switch 146 enables and disables laser 140. Switch 124 enables and disables signal generator 114. Switches 122, 146, and/or 124 may be implemented with circuitry (e.g., conventional timer) that disables the controlled function after a suitable predetermined period to conserve battery power, reduce risk of injury to the user, reduce risk of injury to the target). Light source 116 may be disabled automatically about 5 minutes from the most recent operation of switch 122. Laser 140 may be disabled automatically about 10 seconds from the most recent operation of switches 124 and 146. Signal generator 114 may be disabled automatically about 30 seconds from the most recent operation of switch 124.

A passage includes any structure that mechanically and electrically couples an accessory to a security flashlight. A passage may mount the accessory onto the head of a security flashlight. A passage may further permit light to pass around and/or through the accessory. A passage may be implemented as one or more openings in a surrounding structure of the accessory to facilitate light passing through the one or more openings. Surrounding structure includes any structure that defines a passage in whole or in part. For example, passage 150 of accessory 130 passes beam of light 115 from light source 116. Passage 150 may be open (e.g., for light to travel through air in the passage) and/or include one or more structures for adjusting beam of light 115 (e.g., lens for scattering, focusing, polarizing, coloring).

According to various aspects of the present invention, a mechanical coupling of an accessory to a security flashlight may be facilitated by the shape, material, and/or position (relative to other portions of the accessory) of surrounding structure relative to the shape and/or materials of a head of the security flashlight.

A stimulus signal, as discussed above, includes pulses of current for delivery through target tissue via two or more terminals or electrodes. Pulse timing may be controlled by conventional digital circuitry and/or analog circuitry of the signal generator. Pulse formation generally includes storage and release of energy. A stimulus signal may be used for forming a visible arc through a gap of air between two or more terminals on a security flashlight, for igniting a propellant of an accessory to launch one or more electrodes, and/or for impeding locomotion of a target. According to various aspects of the present invention, the signal that is output from a signal generator, when enabled, is capable of performing any one or more of these functions. For example, in security flashlight 110, signal generator 114 outputs a signal to plurality of terminals 112 for forming a display and/or for performing a local stun, as discussed above. When accessory 130 is held proximate to security flashlight 110, the output signal from plurality of terminals 112 is coupled to plurality of terminals 131 of accessory 130. The signal then activates propellant 136 and/or conducts to plurality of electrodes 134 to perform a remote stun.

In an implementation, a signal generator includes two capacitances. Release of energy from one or both capacitors forms a pulse of current for a stimulus signal. The first capacitance releases energy for forming an arc. The second capacitance releases energy for causing involuntary skeletal muscle contractions. Energy may be repeatedly received then released to provide a series of current pulses. A signal generator may include any conventional electronic components for converting (e.g., transforming) energy into an electrical signal (e.g., current pulse). A signal generator may include any conventional electronic components for providing a signal having characteristics (e.g., voltage magnitude, current magnitude, waveform) suitable for impeding locomotion of a target.

In one implementation a signal generator includes a logic circuit. Logic circuitry, as used herein, may be implemented using conventional circuit design and/or conventional programming technology in light of the present disclosure. Some examples follow. Circuit technology includes combining digital gates, registers, comparators, counters, memory for table look ups, and arithmetic units. Circuit technology includes using a state machine, a programmed sequencer, and/or a programmable processor in combination with programming technology. Programming technology includes microcode, programming gate arrays, contents of look up tables, executable code, machine language code, compiled and/or interpreted programming languages and libraries. Software updates include replacing some or all of the contents of any rewritable memory with replacement programming technology and/or replacing (e.g., substituting, switching, remapping) physical memory components. Logic may be described completely with software; however, a logic circuit cannot be entirely implemented in software. For example, signal generator 114 may include logic circuitry.

Logic circuitry may detect operation by a user of a user interface to perform the functions of a signal generator. Performing may include controlling the operation of a signal generator to output a pulse duration (e.g., from about 10 microseconds to about 120 microseconds), a pulse repetition rate (e.g., 5 to 40 pulses per second, 15 to 19 pulses per second), and/or a period of pulses (e.g., about 5 seconds, about 10 seconds, about 30 seconds). Logic circuitry may select one or more electrodes to launch, determine a suitable pulse for launching one or more electrodes, and determine an amount of charge provided per pulse by a stimulus signal to a target. Logic circuitry may meter the amount of charge delivered through a target to cease delivering charge when a desired amount of charge is delivered. In an implementation having reduced cost and complexity, a signal generator omits a microprocessor and uses analog and/or digital logic circuitry. Charge metering may be omitted to further reduce the cost and complexity of a signal generator.

Signal generator 114, and a suitable user interface of the type discussed above, may be implemented using logic circuitry of the type of any conventional conducted electrical weapon (e.g., marketed by TASER International, Inc. as models X26, X26P, X2, XREP, C2).

An initiation and/or repetition of a performance of a function of a signal generator may be controlled by an operator of security flashlight 110 by subsequent operation of switch 124. The function may include displaying an arc, launching another electrode, stimulating the target (e.g., local stun, remote stun).

For example, in security flashlight 110, signal generator 114 is coupled to terminals 121 and 122 (driven with opposite voltage polarity). These terminals are spaced apart by distance 113 to form a gap. Current from signal generator 114 is provided at a sufficient voltage magnitude to ionize air in the gap of distance 113. The ionization of air across distance 113 causes a visible arc. Because signal generator 114 provides a stimulus signal that includes a series of pulses and because each pulse ionizes air in the gap of distance 113, the arc between terminals 121 and 122 remains visible during provision of the series of pulses. Further, repeatedly establishing the ionization path between terminals 121 and 122 creates an audible sound (e.g., crackling, popping). The visible arc and audible sound may operate as a warning to dissuade a target as discussed above. Terminals 121 and 122 of security flashlight 110 may abut target tissue. When signal generator 114 provides the current to terminals 121 and 122, the current may enter target tissue from one terminal, travel through target tissue, and exit the target tissue through the other terminal thereby providing a local stun. The current through target tissue generally causes pain in the target.

Terminals of a security flashlight operate to establish an electrical circuit (e.g., path) for a signal. Terminals are formed of a material that conducts electricity. Terminals mechanically couple to a security flashlight. Terminals are positioned on a security flashlight for performing the function of providing a path (e.g., circuit) for a signal provided by a signal generator. Terminals are electrically coupled to a signal generator and arranged about the head of the security flashlight to support a relatively high voltage between sets (e.g., pairs) of terminals. While providing a path, terminals may provide a visual and audible warning, ignite a propellant to launch electrodes, and provide a current through launched wire-tethered electrodes to impede locomotion of the target as discussed above. For example, plurality of terminals 112 support displaying an arc and performing a local stun; and, cooperate with plurality of terminals 131 to support activating a propellant, and performing a remote stun.

A cartridge includes any structure supporting electrodes for a remote stun function. An accessory may include an integral cartridge. An accessory may support a removable cartridge. A cartridge may include terminals that abut and/or are positioned proximate to terminals of a security flashlight and/or to terminals of an accessory while the cartridge is mechanically coupled to the security flashlight or accessory. A cartridge may include wire stores or support electrodes that include integral wire stores. A cartridge may include propellant and/or accept propelling gas from a source external to the accessory (e.g., a cylinder of compressed gas worn on the belt of the user).

When an unfired (e.g., electrodes not launched, propellant not ignited, unused) cartridge is coupled to a security flashlight, a signal from the signal generator to the terminals of the security flashlight ionizes air between the terminals of the security flashlight and the terminals of the cartridge so that the cartridge receives the signal from the signal generator. The signal from the signal generator via the terminals may activate the propellant to launch the electrodes or provide a stimulus signal via launched electrodes.

A wire store stores (e.g., stows) a filament (e.g., wire, conductor, fiber) in electrical and mechanical coupling to a signal generator at one end of the filament and to an electrode at the other end of the filament. Electrical coupling exists after launch of the electrode and may exist before and/or during launch. A wire store retains a length of filament prior to launch of an electrode. Generally, a wire store holds filament for a single electrode. A wire store facilitates the deployment (e.g., pay out, extension) of a filament as the electrode associated with the filament is launched. A wire store may be positioned (e.g., located) proximate to the electrode to which it is coupled or be integral with the electrode. A volume of a wire store may determine the amount (e.g., length, diameter) of filament that may be stored in the wire store. A cavity (e.g., chamber) in the body of a cartridge or in the body of an accessory may perform the function of a wire store.

A filament (e.g., wire, conductor, fiber) includes any elongate structure suitable for conducting a stimulus signal through tissue of a target. A filament receives a signal from a signal generator and conducts the signal to an electrode (e.g., continuously, intermittently). Portions of a filament may be insulated or uninsulated. A filament may be positioned in a wire store for deployment responsive to a pulling force exerted by a deploying electrode. A filament may mechanically couple to an electrode to form a wire-tethered electrode, as discussed above.

An electrode includes any structure that extends a filament toward a target, attaches to the target (e.g., tissue, clothing), and conducts a current through tissue of the target. An electrode is effective when positioned in or near target tissue to conduct a current through target tissue. An electrode provides a stimulus signal through target tissue to inhibit locomotion of the target. An electrode may be launched toward a target for providing the stimulus signal. Providing a signal through a target via two or more electrodes, as discussed above, is referred to as a remote stun. Mechanical coupling places the electrode into contact with target tissue and/or target clothing. An electrode may include structures (e.g., barbs) for retaining mechanical coupling with a target. Contact with target tissue may establish an electrical coupling. An electrode may electrically couple to a target, with or without mechanically coupling, by ionizing air in a gap between the electrode and target tissue. The magnitude of the voltage of the signal provided by the signal generator may ionize air in a gap of up to one inch between the electrodes and target tissue. An electrode may include structures (e.g., body, surface) for receiving a force provided by a propellant and translating the force into movement of the electrode. An electrode may include structures for aerodynamic flight after launch. Aerodynamic characteristics of an electrode may improve accuracy in travel from a cartridge to an intended location on a target.

An electrical path of length suitable for general skeletal muscle contractions through target tissue suitable for halting locomotion may be more likely when electrodes are launched at one or more angles from each other and spread to an increasing separation in flight, electrodes at the wider angle(s) are more likely to lodge at points of coupling with the target suitable for causing general skeletal muscle contractions, as opposed to merely pain or discomfort. An angle of separation (between concurrently launched electrodes) may be about 5 degrees to about 10 degrees, preferably about 8 degrees. The position of each launched electrode may be determined by the user (e.g., launching one electrode along a laser beam for each activation of propellant).

Prior to launch, each electrode is stowed (e.g., stored, positioned) in a cartridge or accessory. A cartridge or accessory may include a bay (e.g., cavity, bore, chamber) for storing each electrode prior to launch. A cartridge or accessory may store a plurality of electrodes. Each electrode may be stored in a separate bore. An electrode may be sealed (e.g., retained, held) in a cartridge prior to launch. A lid (e.g., cover) that covers a bore may seal the electrode in the bay. Sealing an electrode prior to launch enables the cartridge to be oriented in any direction without permitting the electrodes to fall from the cartridge. A lid may be removed from covering an electrode by movement of the electrode incident to launching the electrode.

A propellant includes any material or apparatus that provides a force for launching an electrode. A propellant launches (e.g., pushes, propels) one or more electrodes from a cartridge. A propellant launches an electrode from a cartridge toward a target. A propellant may propel electrodes from a cartridge by any conventional technology. The propellant may be stored in a cartridge. In an implementation, a propellant provides a rapidly expanding gas to propel the electrodes. The structure of the body of the cartridge may direct the expanding gas to a rear portion of a bore that holds an electrode to launch the electrode from the bore toward a target. A propellant may be activated (e.g., ignited, released) to provide the rapidly expanding gas by operation of a signal provided by a signal generator. A propellant may be activated by a signal different in electrical characteristics from a stimulus signal. A rapidly expanding gas that launches an electrode may be the gas produced by burning a combustible material (e.g., gun powder, pyrotechnic) or activating a chemical reaction. A rapidly expanding gas may be provided by release of a compressed gas from a sealed container.

Accessory 130 includes plurality of terminals 131 of which terminals 133 and 135 are exemplary. Security flashlight 110 includes plurality of terminals 112 of which terminals 121 and 122 are exemplary. While accessory 130 is coupled to security flashlight 110, terminals 133 and 135 abut and/or are positioned distance 129 away from terminals 121 and 122. Distance 129 is less than distance 113. The signal provided to terminals 121 and 122 by signal generator 114 ionizes the air across distance 129 (instead of distance 113) to terminals 133 and 135 to provide the signal to a plurality of wire stores 132 of which wire stores 141 and 137 are exemplary. Terminals 133 and 135 also electrically couple to propellant 136 that provides propelling force 160. Force 160 moves one or more of plurality of electrodes 134, of which electrodes 143 and 139 are exemplary, away from accessory 130 toward a target (not shown).

In one implementation, an unfired cartridge presents an impedance through propellant 136 that is less than the impedance through wire stores 137 and 141, so current provided by signal generator 114 travels through propellant 136 thereby activating propellant 136. After propellant 136 has been expended to launch one or more electrodes 134, the impedance of propellant 136 increases significantly (or the path through propellant 136 is interrupted) so that subsequent signals provided by signal generator 114 travel through the extended filaments, through plurality of electrodes 134, and through target tissue to perform a remote stun.

Electrodes of plurality 134 extend respective filaments stored in plurality of wire stores 132. For example, as electrode 139 moves away from accessory 130, it deploys (e.g., unwinds, pulls, dispenses) a filament (not shown) from wire store 137. While electrode 139 is positioned in or near target tissue, the filament stretches from electrodes 139 at the target back to accessory 130. While electrode is positioned in or near target tissue, it is electrically coupled to signal generator 114 via terminal 135, gap 113 (if any), and terminal 122.

In the event that the launched electrodes miss the target (e.g., a high impedance remains between electrodes after deployment), rather than contacting a target (e.g., a relatively low impedance exists between electrodes after deployment), self defense apparatus 100 operates in a shunt mode wherein the signal from the signal generator 114 will ionize air in gap 113 without damage to accessory 130.

In another implementation, an accessory may include (i.e., integral) and/or support (e.g., by one or more sockets) one or more cartridges, each cartridge for launching an electrified projectile away from the accessory. Such a cartridge may include one or more propellants and one or more electrified projectiles. Each electrified projectile may include a battery, a signal generator, wire stores, supplemental propellant, and electrodes. The projectile may be of a type described in U.S. Pat. No. 7,042,696 to Smith or U.S. Pat. No. 7,856,929 to Gavin. Electrodes in a nose portion may be likely to be widely separated from electrodes in a tail portion due to separation of the nose portion and tail portion in flight or after impact (though these portions remain tethered to each other). A suitable electrical path length may result from wide physical separation. Some electrodes of a nose portion of an electrified projectile of the type described in U.S. Pat. No. 7,057,872 to Smith face toward the target for impact with the target and some other electrodes face away from the target for impaling a hand of the target. By impaling the hand, a relatively long electrical path through target tissue is likely.

Figure 2:
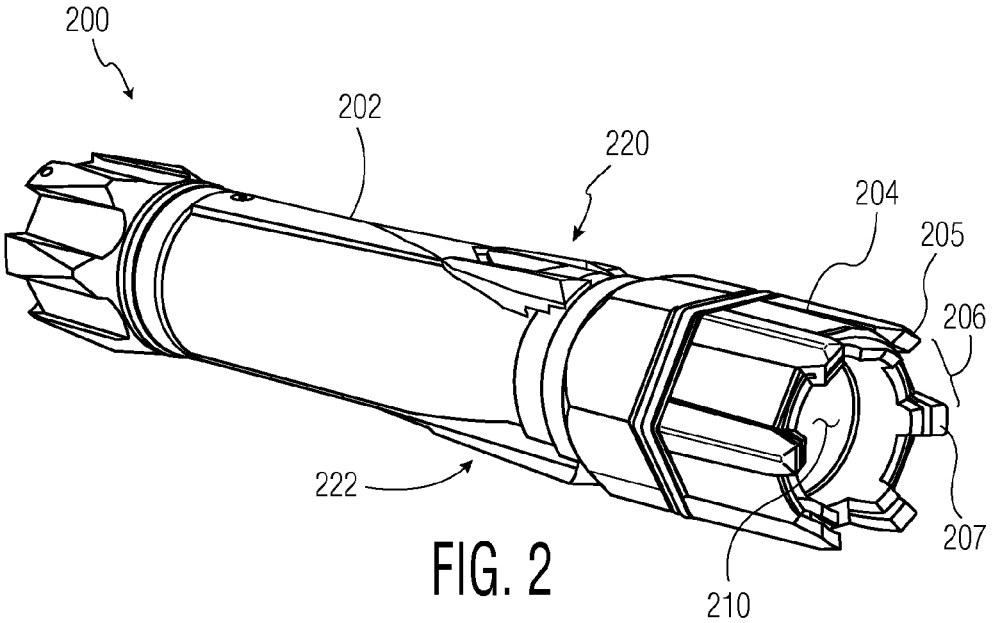
FIG. 2 is a perspective plan view of an implementation of the security flashlight of FIG. 1.

A security flashlight may present an arcing display between terminals in a head portion, away from a grip portion intended for use as a handle. For example, security flashlight 200 of FIG. 2 is an implementation of security flashlight 110. Security flashlight 200 includes grip 202 and head 204. Grip 202 encloses a battery and signal generator (not shown). Grip further includes switches 220 and 222. Head includes a light source (not shown) and terminals 205 and 207 separated by air gap 206. Air gap 206 is an implementation of a gap having distance 113, discussed above.

Switch 220 performs the functions of switch 122 discussed above. Switch 222 performs the functions of switch 124 discussed above. When enabled by switch 220, the battery within grip 202 powers the light source in head 204 to provide illumination via lens 210 in the manner of a conventional flashlight. When enabled by switch 222, the battery within grip 202 powers the signal generator within grip 202 to provide a local stun function via terminals 205 and 207. When target tissue is not proximate to terminals 205 and 207, a display arc function is provided between terminals 205 and 207.

Figure 3:
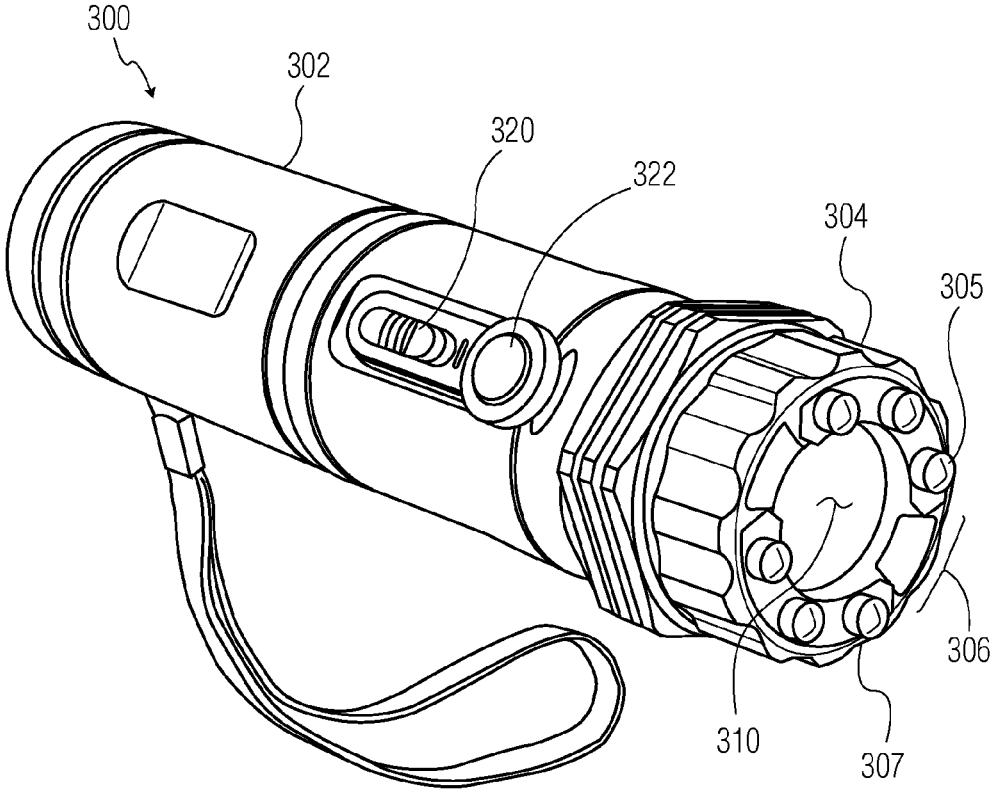
FIG. 3 is a perspective plan view of another implementation of the security flashlight of FIG. 1.

As another example, security flashlight 300 of FIG. 3 is an implementation of security flashlight 110. Security flashlight 300 includes grip 302 and head 304. Grip 302 encloses a battery and signal generator (not shown). Grip 302 further includes switches 320 and 322. Head 304 includes a light source (not shown) and terminals 305 and 307 separated by air gap 306. Air gap 306 is an implementation of a gap having distance 113, discussed above.

Switch 320 performs the functions of switch 122 discussed above. Switch 322 performs the functions of switch 124 discussed above. When enabled by switch 320, the battery within grip 302 powers the light source in head 304 to provide illumination via lens 310 in the manner of a conventional flashlight. When enabled by switch 322, the battery within grip 302 powers the signal generator within grip 302 to provide a local stun function via terminals 305 and 307. When target tissue is not proximate to terminals 305 and 307, a display arc function is provided between terminals 305 and 307.

An accessory, according to various aspects of the present invention, includes any apparatus that mechanically couples to a security flashlight and electrically couples to the head of a security flashlight, to provide a remote stun function. In one implementation the accessory does not interfere with the light sourced by the security flashlight. In another implementation, the accessory includes a passage that passes light sourced by the security flashlight. In yet another implementation, the accessory includes a passage that adjusts light sourced by the security flashlight.

Figure 4:
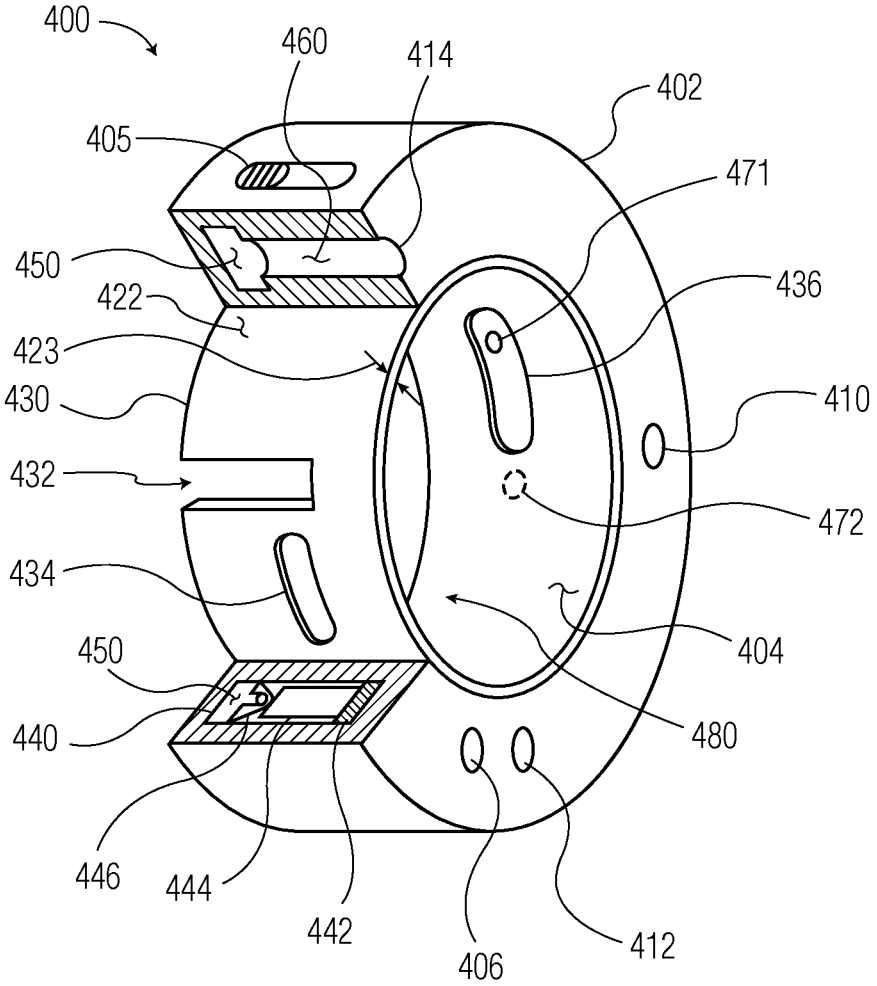
FIG. 4 is a perspective plan view with a partial cut-away describing an implementation of an accessory that cooperates with a security flashlight to provide a remote stun according to various aspects of the present invention.

For example, accessory 400 of FIG. 4 is shaped as an annulus having a central circular opening that serves as a passage as discussed above. Accessory 400 includes an integral cartridge. The annulus serves as surrounding structure, as a cartridge, and as an enclosure for a battery and laser, as discussed above. Accessory 400 may be suitably formed to fit around head 204 (or 304). While accessory 400 is coupled to security flashlight 200 (or 300), light from lens 210 shines through circular passage 480.

Figure 5:
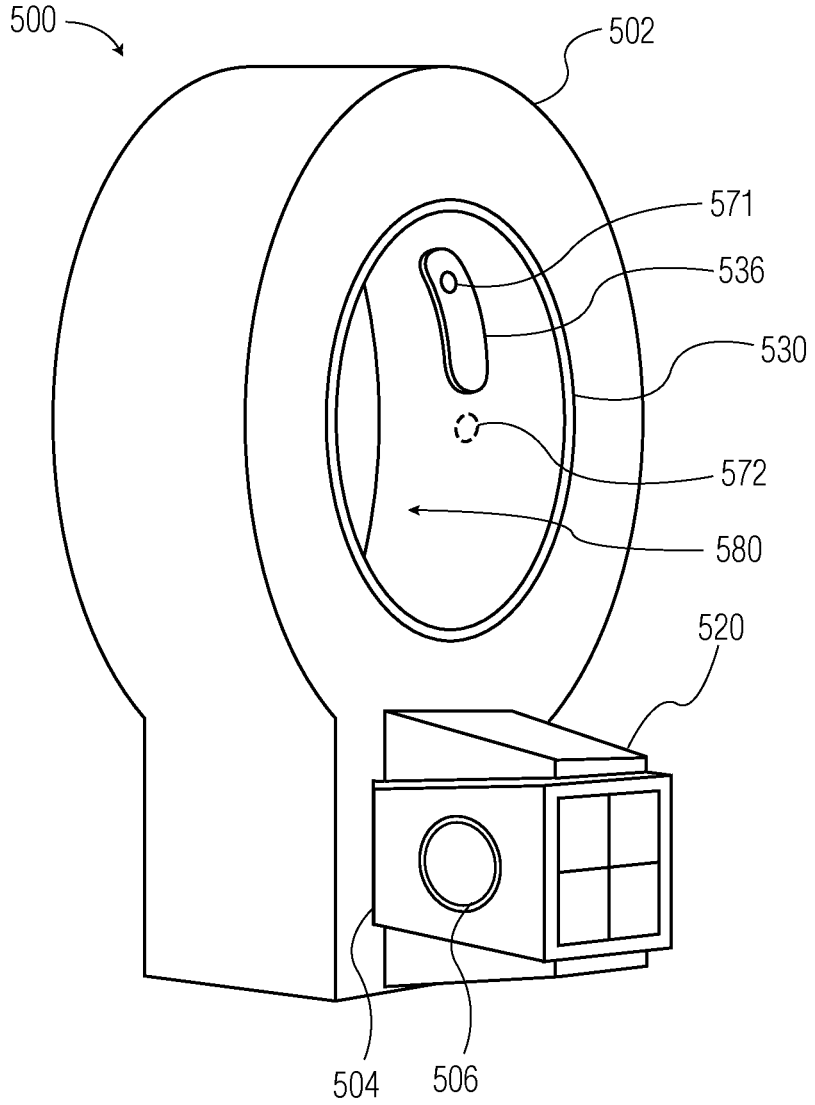
FIG. 5 is a perspective plan view of another implementation of an accessory that cooperates with a security flashlight to provide a remote stun according to various aspects of the present invention.
Figure 6:
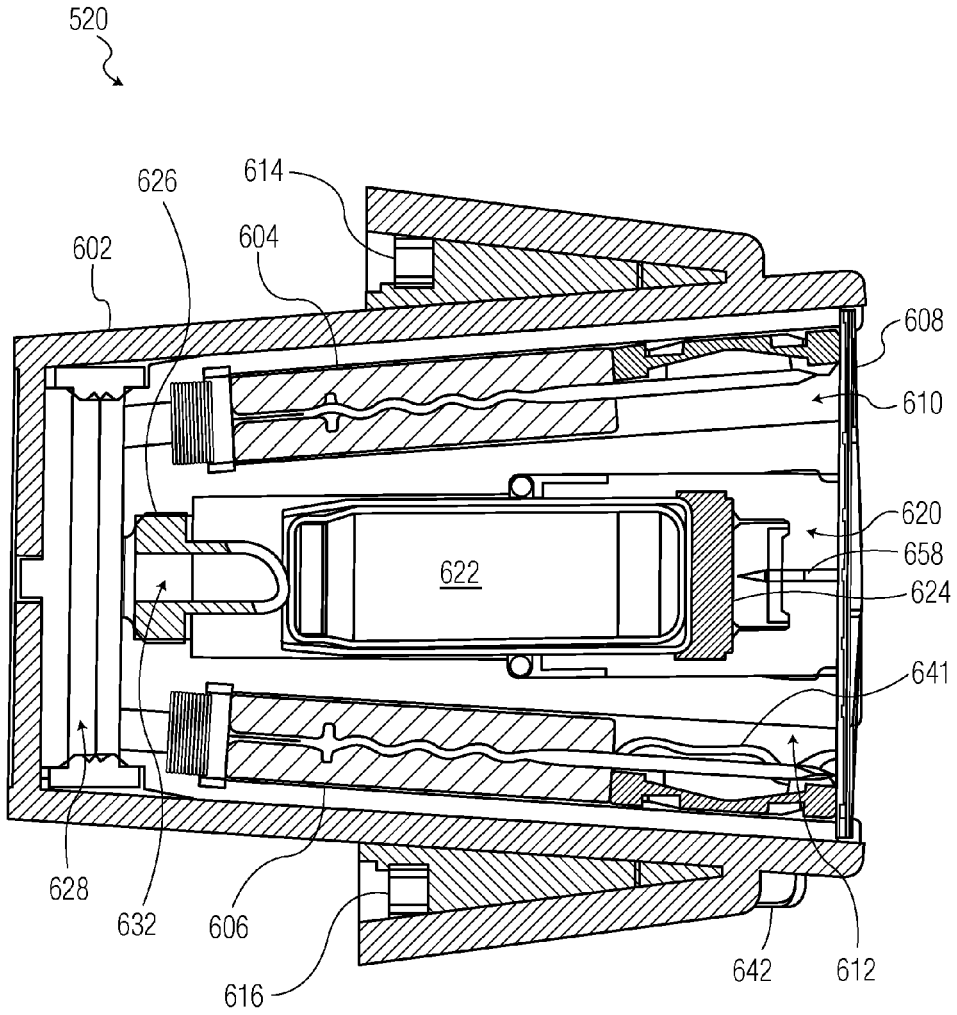
FIG. 6 is a cross section view of the cartridge of the accessory of FIG. 5.

As another example, accessory 500 of FIG. 5 comprises surrounding structure of the type discussed herein with reference to accessory 400. Instead of an integral cartridge, accessory 500 includes a socket for accepting a field-replaceable cartridge. The annulus of accessory 500 serves as surrounding structure and supports a cartridge. Battery 142, switch 146 and laser 140 are omitted from accessory 500. In another implementation, accessory 500 includes these structures in a manner of the type described with reference to accessory 400. Accessory 500 may be suitably formed to fit around head 204 (or 304). While accessory 500 is coupled to security flashlight 200 (or 300), light from lens 310 shines through passage 580.

An accessory may include one of a set of adapters, each adapter formed to accomplish mounting of the accessory to the head of a security flashlight of a particular shape and terminal arrangement. An adapter includes any structure accepted by an accessory that mechanically and electrically couples the accessory to a particular style of security flashlight. Accessories 400 and 500 (and adapters 430 and 530) have circular symmetry about a central axis. In other implementations, other geometric symmetry is used (e.g. hexagon similar to security flashlight 200, knurled similar to security flashlight 300).

Accessories 400 and 500 are implementations of the accessory 130 as discussed above. Accessory 400 includes base 402 and adapter 430. Base 402 performs the functions of a cartridge discussed above, among other functions discussed herein. Adapter 430 performs the functions of an adapter discussed above. Accessories 400 and 500 are formed of conventional materials such as plastics, selected for durability, resiliency, and stability when mounted on a security flashlight (e.g., 200, 300).

Base 402 includes switch 405; bores 410, 412, and 414; opening for laser beam 406; propellant 440; and manifold 450. Bores 410, 412, and 414 house electrodes (not shown) prior to launch. Bore 414, typical of bores 410, 412, and 414, includes cylindrical space 460 coupled to manifold 450. Base 402 further includes a battery, a laser, wire stores, filaments, and electrodes (not shown) having the structure and functions discussed above. An inner surface of base 402 includes a plurality of terminals of which terminals 471 and 472 are exemplary. The plurality of terminals perform the functions of terminals 131 discussed above.

Switch 405 performs the functions of switch 146, discussed above. When closed, the battery of base 402 (i.e., an implementation of battery 142) operates the laser (i.e., an implementation of laser 140), to emit a laser beam through opening 406 as discussed above with reference to laser beam 147.

Propellant 440 includes primer 442, canister 444, and anvil 446. On activation of primer 442 (by a current through primer 442, as discussed above), expanding gas from primer 442 forces canister 444 against anvil 446, cutting open canister 444. Canister 444 contains a compressed inert gas that then flows through one or more orifices or channels of anvil 446 into manifold 450. Manifold 450 directs the force of expanding gas into the rear of bores 410, 412, and 414, against electrodes in bores 410, 412, and 414 to propel the electrodes away from accessory 400. Bores may be covered with a lid, as discussed above, to protect the electrodes while in base 402 prior to launch. Each electrode may move a respective lid aside (or pierce the lid) so that the electrode may exit the bore. As discussed above, the electrodes deploy a respective filament as they travel toward the target. Electrodes positioned in or near target tissue then provide a stimulus signal through the target to provide a remote stun to the target.

An adapter is formed to fit inside (and may be affixed to) an interior surface of base. An adapter may be formed as a brace (e.g., collar, sleeve, ring, clasp, clip). An adapter may be formed as a closed structure (e.g., triangle, square, hexagon, circle, ellipse) or as an open structure (e.g., clasp, clip).

For example, adapter 430 has a closed circular geometry. Adapter 430 includes inner surface 404, outer surface 422, key 432, and slots 434 and 436. Inner surface 404 and key 432 are formed to accomplish suitable rigid, oriented, mechanical coupling of accessory 430 to a particular security flashlight (e.g., 200, 300). Slots 434 and 436 are formed to accomplish suitable electrical coupling of accessory 430 to a particular security flashlight (i.e., coupling of terminals 112 with terminals 131, discussed above).

A key accomplishes a unique orientation of a security flashlight and an accessory. For example, key 432 represents any apparatus (e.g., slot, wedge, ridge, detent, bump) that mates with a corresponding structure of a head of a security flashlight. Orientation assures that terminals of security flashlight (of the type discussed above with reference to terminals 112) are coupled to suitable electrodes of adapter 430 so that a complete circuit is formed by filaments, launched electrodes, and tissue of the target. Thickness 423 of adapter 430 between surface 404 and surface 422 may be uniform as shown in FIG. 4, or may vary about an axis of symmetry of base 402 to fit either or both of the head of a security flashlight and the interior surface of base 402.

To allow one accessory package design to be used with various adapters and security flashlights, each adapter 430 includes apparatus to either expose or insulate each of a plurality of terminals of the type illustrated as terminals 471 and 472 and discussed above with reference to plurality of terminals 131. For example, for a security flashlight having a plurality of terminals 112, as discussed above, slot 436 exposes terminal 471 for electrical coupling to a terminal of the plurality of terminals 112 (e.g., 206, 207, 306, 307) and insulates terminal 472 from all terminals of the plurality of terminals 112. In an analogous manner, slot 434 exposes another terminal (not shown) to complete one or more circuits in base 402. One such circuit passes current through primer 442. Another such circuit passes current through filaments, electrodes, and target tissue.

Insulating selected terminals or portions of terminals (of which terminals 471 and 472 are exemplary) facilitates electrical coupling of a signal generator to a cartridge. Insulating is sufficient when each distance corresponding to distance 129 is shorter than any distance corresponding to distance 113. Without insulating, an arc is likely to form between terminals of the security flashlight (e.g., corresponding to terminals 112) thereby reducing the effective electrical coupling of the signal generator to the cartridge via the cooperation of terminals 112 and 131.

Accessory 400 or 500 may be disposable so that after base 402 or 520 is fired, accessory 400 or 500 may be decoupled from the security flashlight and replaced with a new accessory 400 or 500. Base 402 or 520 may be disposable so that it may be decoupled from adapter 430 or 530 after firing and replaced with an unfired base 402 or 520.

The structure of adapter 430 defines passage 480. When adapter 430 is coupled to a head (e.g., 204, 304) of a security flashlight, the head fits at least partially into passage 480 so that the lens (e.g., 240, 340) of the security flashlight is not blocked or obscured. Passage 480 performs the function of passage 150 discussed above. Passage 480 may further support a lens (not shown) to adjust illumination as discussed above.

Accessory 500 performs the functions of an accessory 130 discussed above. Accessory 500 accepts a provided cartridge into a socket that mechanically supports the cartridge with respect to the security flashlight and electrically couples the cartridge to a head of a security flashlight. The socket facilitates installation and removal of field-replaceable cartridges.

Accessory 500 includes base 502, socket 504, cartridge 520, a plurality of terminals (i.e., an implementation of plurality of terminals 131) of which terminals 571 and 572 are exemplary, and adapter 530. Base includes conventional wiring from the plurality of terminals (i.e., an implementation of plurality of terminals 131) to socket 504.

Cartridge 520 is mounted in socket 504. Cartridge 520 is of the type discussed above with reference to cartridge 111. Cartridge 520 further includes a releasable latch. When cartridge 520 is installed in socket 504, the latch holds cartridge 520 onto base 502. The latch is operated by the user without tools by squeezing button 506 on a first side of cartridge 520 and a corresponding button (not shown) on an opposing side (hidden from view).

Adapter 530 is of the type discussed above with reference to adapter 430. Adapter 530 provides the surrounding structure to define passage 580. Adapter 530 may include a key (not shown) that functions to orient accessory 500 onto the head of a security flashlight (e.g., 200, 300).

A cartridge, of the type discussed above with reference to cartridge 111 of FIG. 1, may further include a mechanical interface and an electrical interface for field-replaceable use with an accessory. For example, cartridge 520, shown in cross-section in FIG. 6, includes housing 602, electrodes 604 and 606, lid 608, bores 610 and 612, contacts 614 and 616, propellant 620, and manifold 628. Cartridge further includes a wire store and filament (not shown) for each electrode 604 and 608, and a latch (not shown) as discussed above with reference to FIG. 5. In one implementation, conventional technologies for cartridges of conducted electrical weapons are used (e.g., cartridges for conducted electrical weapon models X26, X2, C2 marketed by TASER International, Inc.).

Contacts 614 and 616 correspond to plurality of terminals 131, discussed above. Terminal 616, by conventional wiring technologies, passes current into a wire store (not shown) through filament 641 stored in the wire store, through electrode 606.

Housing 602 of cartridge 520 may be inserted into cavity 504 to mechanically and electrically couple cartridge 520 to base 502 and thereby to the security flashlight that is coupled to accessory 500.

Propellant 620 includes primer 624, canister 622, and anvil 626. The stimulus signal from pin 658 ignites primer 624. Primer 624 burns to produce an expanding gas that pushes canister 622 toward anvil 626. Anvil 626 pierces canister 622 to release compressed gas held in canister 622. Gas expands rapidly through channel 632 of anvil 626 and via manifold 628 to the rear of bores 606 and 608.

Bores 610 and 612 house wire-tethered electrodes 604 and 606, respectively. Bores 610 and 612 are open to manifold 628. The rear portion of electrodes 604 and 606 couple to filaments 638 and 636 respectively so that when each electrode is forced out of its bore by the propellant, the electrode pulls its filament from its wire store. Lid 608 is removed by movement of electrodes 604 and 606. Because lid 608 includes a portion of the circuit through pin 658 and primer 624, removal of lid 608 opens that circuit.

If after launch electrodes 606 and 608 are positioned in or near target tissue, then the stimulus signals from the security flashlight are carried through the target via the contacts of base 502, the conductors of base 502, contacts 650 and 652, filaments 636 and 638, electrodes 606 and 608, and target tissue to perform a remote stun.

In operation, the stimulus signal from the signal generator of the security flashlight (e.g., 200, 300) passes via terminals 112 (e.g., 205, 207, 305, 307) of the security flashlight to terminals 131 (e.g., 571) of accessory 500, through conductors (not shown) in base 502, then via socket 504 to contacts 614 and 616 of cartridge 520. Contacts 614 and 616 pass the current across the lid 608 to expose primer 624 to initiating voltage. Contacts 614 and 616 also pass the current to filaments (e.g., 641) to electrodes 604 and 606 for the remote stun function. In addition, contacts 614 and 616 pass the current to terminals at the top (not shown) and bottom (642) to facilitate performing a local stun after the cartridge has been fired.

In another implementation, a passage 150 of a self-defense apparatus, otherwise of the type discussed above with reference to FIG. 1, does not pass beam of light 115. In this implementation, the self-defense apparatus includes a security flashlight (i.e., an implementation of security flashlight 110) having a front face through which light 115 shines, a plurality of terminals 112 arranged near the front face, and an accessory (i.e., an implementation of accessory 130 except as to passage 150). The accessory comprises a passage (in place of passage 150) into which the security flashlight is pressed until the front face of the security flashlight and a front face of the accessory are substantially co-planar. The head of the security flashlight that supports the light source is inside the passage. The passage does not extend beyond the front face of the security flashlight.

An accessory may electrically couple to a security flashlight via terminals on the face of the accessory. An adapter for such an accessory may include voids in the face of a flange portion of the adapter to expose terminals of the accessory to terminals of the security flashlight.

Figure 7:
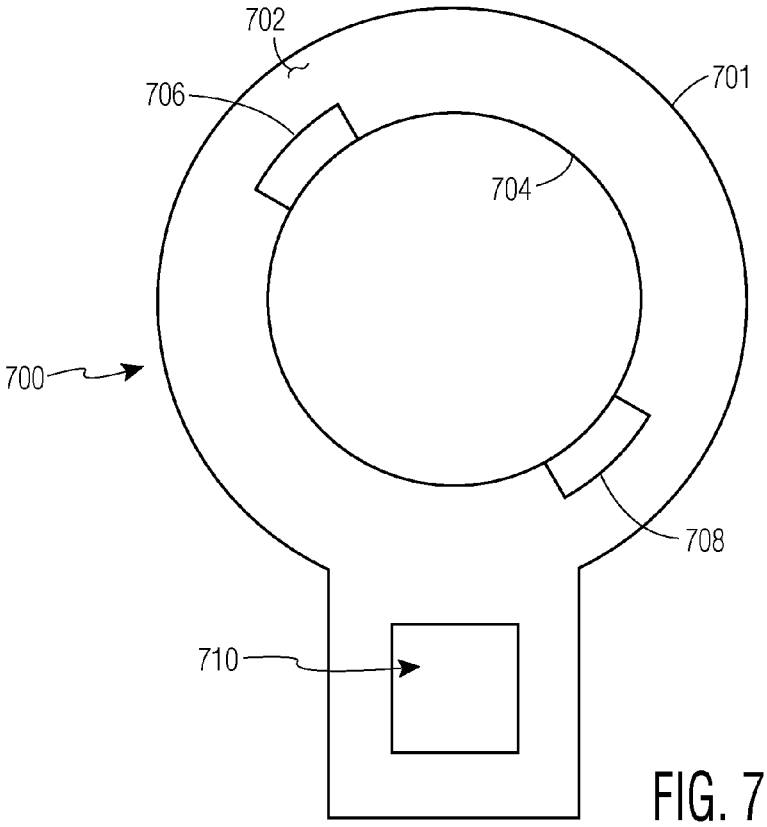
FIG. 7 is a front view of an accessory in another implementation.
Figure 8:
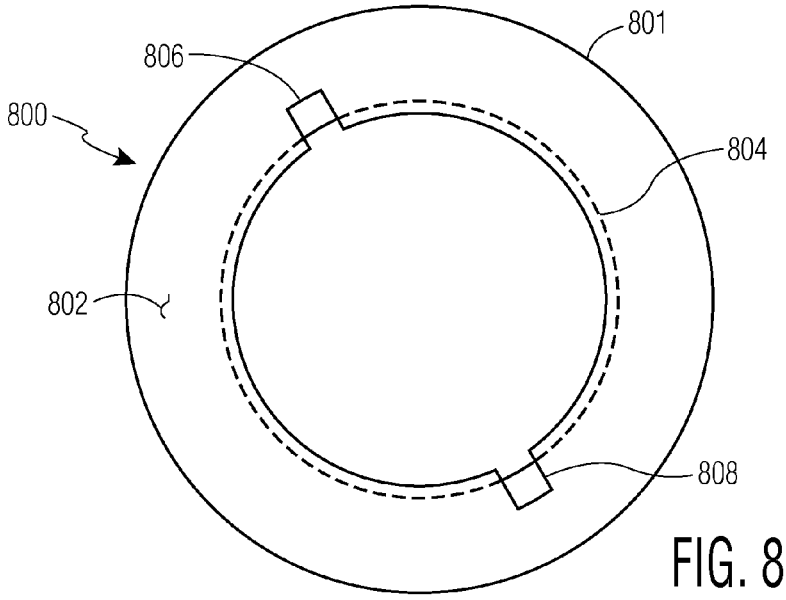
FIG. 8 is a front view of an adapter for use with the accessory of FIG. 7.

For example, accessory 700 of FIGS. 7-8 is an implementation of accessory 130, discussed with reference to FIGS. 1 and 5, that supports a field-replaceable cartridge. Accessory 700 includes base 701 and adapter 800 of FIG. 8. Base 701 includes surface 704, front face 702, terminals 706 and 708, and socket 710. Base 701 includes cylindrical surface 704. Adapter 800 includes flanged tube 801 having tubular portion 804 and a flange having front face 802. Front face 802 includes voids 806 and 808. Adapter 800 is assembled onto base 701 by orienting voids 806 and 808 over a suitable portion of terminals 706 and 708 and inserting tubular section 804 against surface 704. Socket 710 mechanically supports a cartridge (e.g., 520). Wiring internal to base 701 (not shown) electrically couples terminals 706 and 708 to socket 710 to enable all operations of a cartridge, as discussed above. Accessory 700 is formed of conventional materials such as plastics, selected for durability, resiliency, and stability when mounted on a security flashlight (e.g., 200, 300).

Adapter 800 is formed of insulating material (e.g., plastic, rubber) to insulate portions of terminals 706 and 708 that are not exposed through voids 806 and 808. Terminals 706 and 708 perform the functions of plurality of terminals 131 discussed with reference to FIG. 1, including coupling the signal generator of a security flashlight to a cartridge of the accessory. Insulating portions of terminals 706 and 708 facilitate electrical coupling of a signal generator to a cartridge. Insulating is sufficient when each distance corresponding to distance 129 is shorter than any distance corresponding to distance 113. Without insulating, an arc is likely to form between terminals of the security flashlight (e.g., corresponding to terminals 112) thereby reducing the effective electrical coupling of the signal generator to the cartridge via the cooperation of terminals 112 and 131.

In various implementations, the shape, size, placement, and quantity of terminals on front face 702 are selected to accomplish insulating, as discussed above, for other types of security flashlights. In a first example implementation, wherein adapter 800 mounts onto the head of security flashlight 200, diametrically opposing voids 806 and 808 are proximate to opposite polarity terminals of security flashlight 200. In a second example implementation, wherein adapter 800 mounts onto the head of security flashlight 300, diametrically opposing voids 806 and 808 are proximate to opposite polarity terminals of security flashlight 300.

In other implementations, an accessory includes insulating structure to inhibit arcing through distance 113 (e.g., 206, 306). For example, such an accessory may include one or more walls placed between opposing polarity terminals of plurality of terminals 112 (e.g., occupy part of distance 206, occupy part of distance 306). A wall may surround a terminal (e.g., 121, 122, 205, 207, 305, 307). When insulating structure inhibits arc formation between terminals 112, distance 129 may be greater than or equal to distance 113 (contrary to the limits discussed above) as long as arc formation across distance 129 occurs at a lower voltage than arc formation across distance 113.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below.

What is claimed is:

1. An accessory for coupling to a provided security flashlight, the security flashlight capable of performing a local stun function, the accessory for adding a remote stun function to the security flashlight, the accessory comprising:

a base having a passage therethrough, the passage for mechanically and electrically coupling the accessory to the security flashlight such that light provided by the security flashlight passes through the passage to illuminate an area, and that supports a provided cartridge that performs the remote stun function; and a plurality of terminals, configured to accept a signal from the security flashlight and pass the signal to the cartridge to perform a function of the cartridge.

2. The accessory of claim 1 wherein the plurality of terminals is arranged in the passage.

3. The accessory of claim 1 wherein the base further comprises the cartridge, integral to the base.

4. The accessory of claim 2 wherein the plurality of terminals is arranged in the passage.

5. The accessory of claim 1 wherein:

the security flashlight includes a user interface;

the cartridge is separable from the base; and the base further includes a socket that mechanically and electrically couples the cartridge to the accessory so that operation of the user interface of the security flashlight operates the cartridge.

6. The accessory of claim 5 wherein the plurality of terminals is arranged in the passage.

7. The accessory of claim 1 wherein:

the security flashlight comprises a plurality of local stun terminals; and the accessory further comprises an adapter for insulating at least one of the plurality of terminals of the accessory from at least one of the plurality of local stun terminals.

8. The accessory of claim 7 wherein the adapter is located within the passage and further defines the passage.

9. The accessory of claim 8 wherein the plurality of terminals is arranged in the passage.

10. The accessory of claim 7 wherein the adapter comprises a key that orients the accessory to the security flashlight.

11. The accessory of claim 1 further comprising a battery, a laser, and a switch that supplies current from the battery to the laser for operation of the laser as a sight.

12. An accessory for coupling to a provided security flashlight, the security flashlight capable of performing a local stun function, the accessory for adding a remote stun function to the security flashlight, the accessory comprising:

a base that includes a passage therethrough, a socket, and a plurality of terminals; wherein:

the base is configured to mechanically couple to the security flashlight such that a beam of light provided by the security flashlight passes through the passage to illuminate an area;

the socket is configured to mechanically and electrically couple in a removable manner to a provided cartridge;

the plurality of terminals is configured to receive a signal from the security flashlight and to provide the signal to the cartridge to perform a remote stun function.

13. The accessory of claim 12 wherein the base encircles the security flashlight to mechanically couple to the security flashlight.

14. The accessory of claim 12 wherein the plurality of terminals is positioned in the passage.

15. The accessory of claim 12 wherein the base further includes a plurality of slots, wherein the terminals receive the signal via the plurality of slots.

16. The accessory of claim 12 wherein the base further includes a key, wherein the key orients the base with respect to the security flashlight.

17. The accessory of claim 1 wherein:

the security flashlight includes a plurality of local stun terminals; and the accessory further includes an adapter;

the adapter includes a passage therethrough that is coaxial with the passage of the base so that the beam of light passes through the passage of the base and the adapter; and the adapter is configured for insulating at least one of the plurality of terminals of the base from at least one of the plurality of local stun terminals.

* * * * *